United States Patent [19]

Murphy

[11] Patent Number: 4,828,662

[45] Date of Patent: May 9, 1989

[54] ELECTROLYTIC STRIPPING OF COBALT

[75] Inventor: Thomas P. Murphy, Wantage, England

[73] Assignee: MB Group plc, Reading, England

[21] Appl. No.: 186,861

[22] Filed: Apr. 27, 1988

[30] Foreign Application Priority Data

May 12, 1987 [GB] United Kingdom ..... 8711201

[51] Int. Cl.[4] ..... C25F 5/00

[52] U.S. Cl. ..... 204/146; 204/129.75

[58] Field of Search ..... 204/146, 129.1, 129.75, 204/48, 224 R

[56] References Cited

U.S. PATENT DOCUMENTS 3,721,626 3/1973 Stanek et al. ..... 204/146 X
3,773,629 11/1973 Sieckmann et al. ..... 204/146 X
4,144,160 3/1979 Faulkner ..... 204/224 R
4,400,248 8/1983 Tomaszewski ..... 204/146
4,439,289 3/1984 Viglione ..... 204/146

*Primary Examiner*—Donald R. Valentine
*Attorney, Agent, or Firm*—Diller, Ramik & Wight

[57] ABSTRACT

A method of removing a layer of cobalt from an underlying nickel surface of an article comprises the steps of immersing at least part of the article in an aqueous solution of a caustic alkali having a pH value not less than 12.5 and preferably not less than 14, and applying an electrical potential difference between the article and a counter electrode which acts as a cathode to strip the cobalt from the article leaving the nickel passive. The method is particularly suitable for removing a defective cobalt layer from a data storage disc so that the disc can be recoated.

11 Claims, 4 Drawing Sheets

ELECTROLYTIC STRIPPING OF COBALT

BACKGROUND OF THE INVENTION

1. Field of the Invention

This invention relates to the electrochemical removal of a surface layer from an article, and more particularly but not exclusively to the removal of a defective coating from data storage disc to facilitate recoating.

2. Background Art

A known data disc comprising as substrate a disc of aluminium is approximately 130 mm diameter by 1.9 mm thick when coated. A central aperture of 40 mm diameter penetrates the disc. These data discs are coated overall by a sequence of sputter coating, electroless coating or other plating treatments to create a finished disc having a substrate core disc of aluminium having a zincate treatment on both sides clad by a layer of nickel; a layer of cobalt covering the nickel; a thin (flash) layer of chromium on the cobalt; and outer layer of carbon covering the flash layer of chromium. During manufacture of these discs defects may arise in any of the deposited layers. Current practice is to examine the finished discs and discard any that fail to meet the test criteria.

SUMMARY OF THE INVENTION

One objective of this invention is to provide a method of recovering as much value as possible from defective discs by removing one or more of the layers so that any sound remaining material may be recoated to manufacture a vendible disc.

Another objective of this invention is to provide a method of removing the cobalt layer to uncover the textured finish on the nickel layer. This textured finish is in the form of circular grooves which assist the aerodynamic forces and help align magnetic domains. The brushing or wiping technique used to create the textured finish is quite costly so it is advantageous to retain the finish.

The stripping of coatings from data discs by means of acid treatments has been reported but these acid systems require great care in order to avoid stripping off more than the defective layer.

In contrast the present invention uses high pH electrolytes and application of controlled potential differences between the disc and a counter electrode to achieve a controlled degree of stripping.

In a first aspect this invention provides a method of removing a layer of cobalt from a nickel surface of an article, said method comprising the steps of immersing at least part of the article in an aqueous solution of caustic alkali, and applying an electrical potential difference between the article and a counter electrode which acts as a cathode to strip the cobalt from the article and maintain the nickel in the passive state.

The pH value of the aqueous solution of caustic alkali is preferably greater than 12.5. A preferred value is about 14.

In one embodiment of the method the aqueous solution is 20% Na OH in distilled water. The electrical potential difference is within the range of 10 to 15 volts. In a preferred method the solution is stirred or agitated either by an impeller or by rotating the article which may be a data storage disc made of aluminium coated with nickel. The article, after anodic stripping may be cleaned by a cathodic treatment in which the article is immersed in a buffer solution of citric acid and sodium citrate and an electrical potential difference is applied between the article and a counter electrode.

In another aspect this invention provides apparatus for removing a layer of cobalt from the nickel surface on a disc, said apparatus comprising a trough to contain electrolyte sufficient to immerse most of the disc, means to support the disc for rotation, and means to make electrical contact with the periphery of the disc at a point above the meniscus of the electrolyte.

The means to contact the periphery of the disc may comprise a guide tube, a brush member slidable in the guide tube and resilient means in the form of an elastomeric block in the guide tube to urge the brush member towards the periphery of the disc. The guide tube may be shrouded by a sleeve of polymeric material having a cleft at one end to wipe the periphery of the disc before electrical contact is made.

DESCRIPTION OF THE PREFERRED EMBODIMENTS

Figure 1:
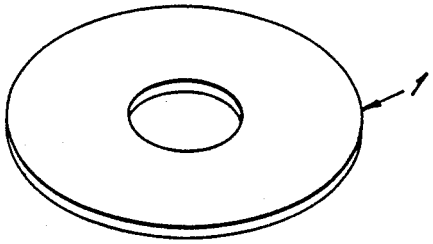
FIG. 1 is a perspective sketch of a data disc.
Figure 2:
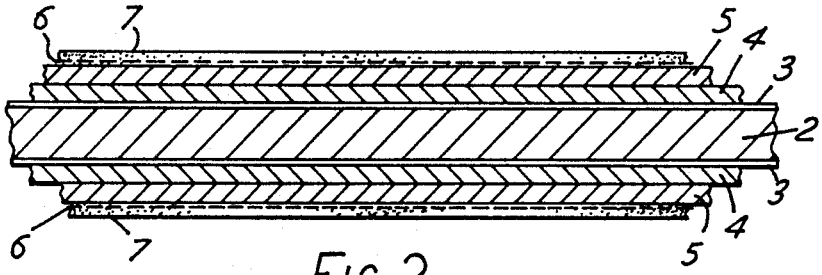
FIG. 2 is an enlarged fragmentary section through the disc of FIG. 1.

FIG. 1 shows a data storage disc of 130 mm diameter, approximately 2 mm thick and having a central aperture of 40 mm diameter. FIG. 2 shows that the disc 1 comprises a core 2 of aluminium coated overall with a zincate coating 3. A layer of nickel 4 covers the zincate coating 3. A layer of cobalt 5 covers the nickel layer 4. A thin "flash" layer of chromium 6 covers the cobalt layer 5 and a layer of carbon 7 covers the "flash" of chromium. The various layers are usually deposited by a sequence of sputtering or electrolytic coating treatments as already mentioned.

If, after deposition of the various layers, any layer on a disc was found to be defective the defective disc was scrapped at considerable cost. The present invention seeks to abate this loss by stripping off the defective layers to retain as much sound material as possible for retreatment.

Figure 3:
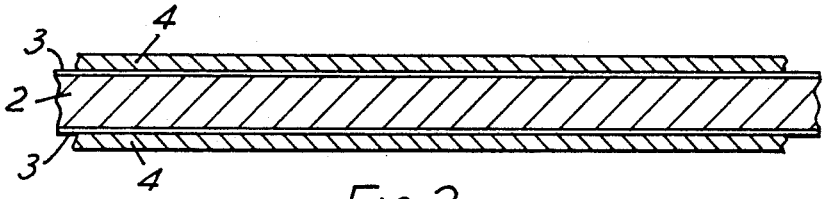
FIG. 3 is a fragmentary section of the disc of FIG. 2 after removal of surface layers.

FIG. 3 shows the disc after the carbon, chromium, and cobalt layers have been stripped away to leave a nickel covered disc ready for recoating.

The defective layers are removed by a series of steps which include:

1. Precleaning by cathodic cleaning procedure or other means. This step may not be necessary if the discs are factory scrap but may be desirable if used discs are being recycled.

2. Whole or partial immersion of the disc in a treatment bath containing an electrolyte and having means to apply an electrical potential difference between the disc and a counter electrode.

3. Application of a controlled electrical potential difference to create a passive condition on the nickel surface but also remove the covering layers.

4. During electro stripping the discs may be rotated or alternatively the electrolyte may be stirred or both.

5. Rinsing of the stripped discs in deionised water.

6. Transfer of the stripped discs to a cleaning bath in which a cathodic treatment is applied. The cleaning solution will generally be of a lower pH than the treatment bath.

7. Application of necessary potential to effect cathodic cleaning.

8. Rinsing and drying of discs - effected by deionised water and clean dry air respectively. Alternatively a displacement drier using 'FREON' may be used.

Removal of each layer requires a specific treatment; for example:- To remove a defective carbon layer the disc is dipped in a solution of 35% nitric acid in water for 5 to 10 seconds and then vigorously rinsed in deionised water to remove the loosened carbon.

To remove a defective cobalt layer, the covering layers if present, are first removed by the acid treatment used to remove the carbon. The cobalt covered disc is then immersed in a solution of 20% caustic soda (Na OH) in distilled water, this electrolyte having a pH approximately equal to 14. A total cell voltage of 10 to 15 volts, measured across the disc and a counter electrode, is applied to achieve a current density (for a disc of 130 mm diameter) of between 1 to 6 amps/single disc face area; a useful current density is about 3 amps/disc single face area, (approximately 75 $m^A$/sq.cm).

Clearly some variation in current density and consequently time scale is possible. It is desirable that the current density is in the range of 50 $m^A$ to 100 $m^A$ per sq.cm. Current densities greater than about 10 $m^A$/disc face may be employed but such low current densities are less reliable than the preferred range indicated above because such low current densities may not maintain the under-layer of nickel in a passive state. The current is applied for a period of time, usually about 10 seconds to remove the cobalt covering and leave the nickel layer intact with its textured surface unimpaired.

Figure 8:
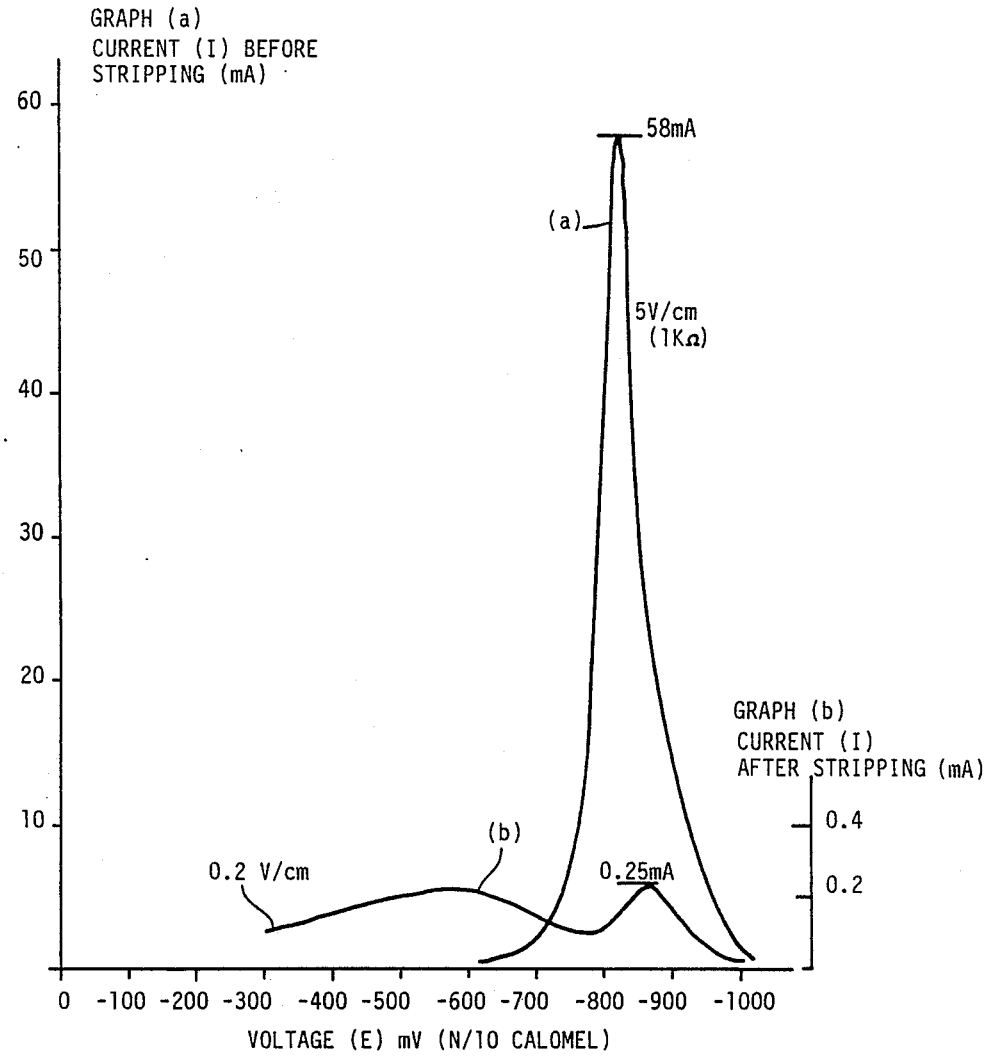
FIG. 8 is a graph (a) of voltage v current before stripping; and a graph (b) on a larger scale of voltage v current after stripping.

FIG. 8 shows typical current v. voltage plots arising from study of a small sample cut from disc before (as shown in graph (a)) and after stripping (as shown in graph (b)) of the cobalt layer. To confirm the success of the stripping process as indicated by this potential scanning test, further samples were tested by examination under a scanning electron microscope (SEM) the results of which are shown in FIGS. 9 and 10.

Figure 9:
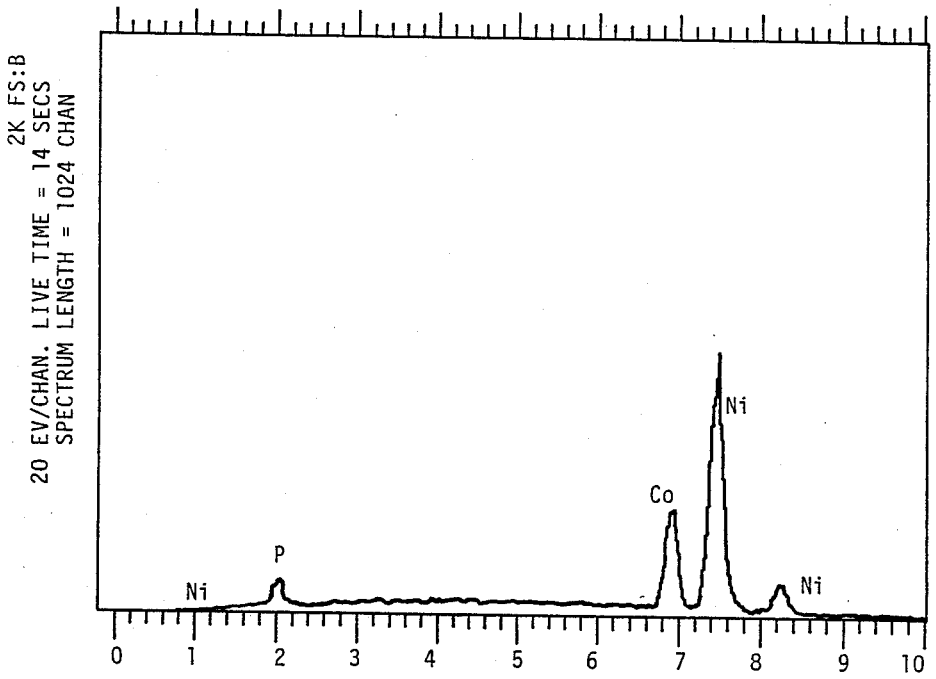
FIGS. 9 and 10 are scanning electron microanalysis traces of discs before and after stripping of a cobalt coating.
Figure 10:
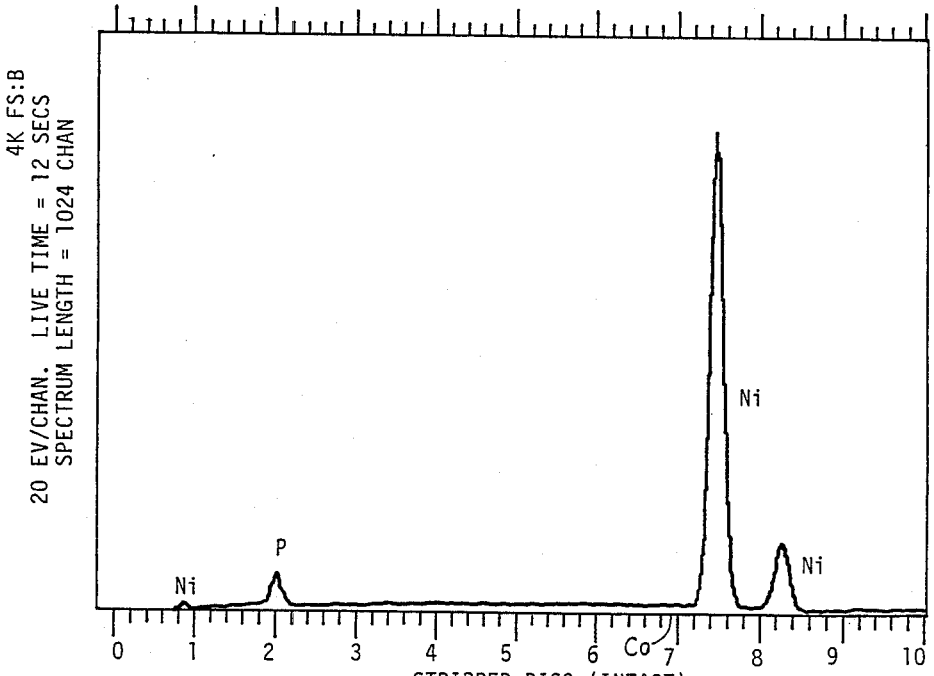

In FIG. 9, which arises from study of an unstripped disc, it will be seen that both cobalt and nickel are present as indicated by their Ka peaks. It will also be noticed that some phosphorus is associated with the nickel layer. In FIG. 10 it will be seen that the stripped disc manifests the Ka peak for nickel but no peak is apparent for cobalt so success of the anodic stripping process is confirmed.

During electrolytic stripping of the cobalt the surface of the disc may become darkened to a dark brown or black colour. This colouration is easily removed by a cathodic treatment.

To clean a disc stripped of cobalt, each disc is immersed in a buffer solution of 12.8 g of citric acid and 11.2 g of sodium citrate per liter of water (pH=4) and a current of 3 amps per face of the disc is passed with the disc as cathode to a counter electrode for a period of about 20 seconds. During this treatment it is desirable to rotate the disc or agitate the solution or both. Rubbing of the surface of the disc with a gloved finger or brush assists removal of the dark colouration.

From the foregoing explanations it will be understood that it is possible to take discs at any stage in production at which defects are detected and strip off a defective layer or layers to leave the disc ready for retreatment.

Should defects in the nickel layer expose aluminium they should be revealed by rapid attack during the immersion in caustic soda solution at a high PH value. In fact none of the discs examined have behaved thus but a potentially useful test appears to be available.

Figure 4:
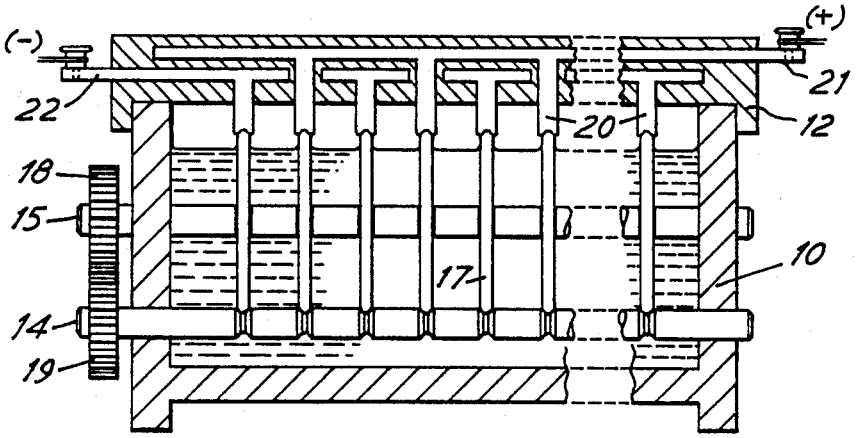
FIG. 4 is a sectioned side view of apparatus for removing surface coatings.
Figure 5:
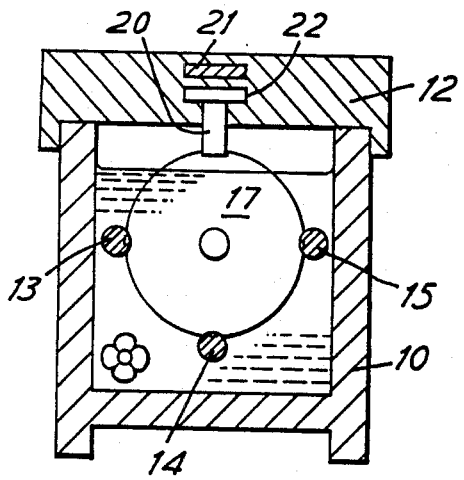
FIG. 5 is a sectioned end view of the apparatus of FIG. 4.

FIGS. 4 and 5 show, in simplified form, apparatus for carrying out the anodic or cathodic treatments described above.

In FIGS. 4 and 5 the apparatus comprises a trough 10 and a lid 12. The trough 10 contains the electrolyte through which passes three spindles 13, 14, 15. The spindles each have a plurality of annular grooves aligned with like grooves in the other spindles so that a group of three annular grooves of the spindles is able to support a disc 17 upright with a small arc of the disc protruding above the meniscus of the electrolyte.

Each spindle 13, 14, 15, passes through an end wall of the trough 10 to terminate in a gear wheel 18, 19 which is meshed with like gear wheels of the other spindles so that rotation of any one of the gear wheels by a motor causes all the spindles to rotate and so rotate all discs in the trough to make continued contact with respective contact brushes fixed in the lid 12.

Figure 5A:
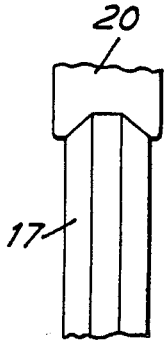
FIG. 5A is an enlarged side view of part of a disc and contact brush.

The lid 12 is made up of layers of insulating material which contain an electrically positive busbar 21 and a negative busbar 22. Brush holders, fixed to each busbar protrude through the insulating layers to support contact brushes 20 in conductive contact with the periphery of a respective disc as can be seen in FIG. 5A.

For an anodic treatment of discs, the discs to be treated will be fitted into the apparatus in contact with the contact brushes of the positive busbar 21. Further discs (which may be plain aluminium discs) will be fitted in contact with the brushes of the negative busbar 22 to act as counter electrodes.

The caustic soda 20% Na OH solution, having a pH=14, is corrosive to many brush materials.

Figure 6:
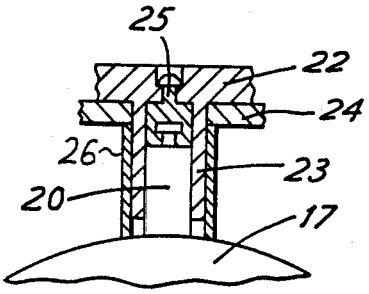
FIG. 6 is a sectioned side view of an alternative contact brush support.
Figure 7:
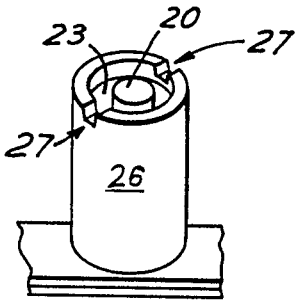
FIG. 7 is a perspective sketch of the brush support of FIG. 6.

In FIG. 6 it will be seen that the brush support may comprise a guide tube 23 attached to busbar 22 and passing through the insulating layer 24 to terminate at a distance from the periphery of the disc 17. A brush member 20 is resiliently urged by a block 25 of rubber or suitable elastomeric polymer to slide along the guide tube 23 to make electrical contact between the charged guide tube 23 and the periphery of the disc 17. As the springy block 25 is a snap fit in the busbar 22 and a snug fit in the guide tube 23 there is minimal risk of electrolyte interferring with its action. If desired a spring may be used instead of the resilient block 25 but care must be taken to choose a spring material that will not corrode. The brush member 20 is also a snug fit in the guide tube 23 so that it makes good electrical contact with the guide tube 23 and therefore stays reasonably clean but replaceable when it becomes worn by pushing the springy block 25 out of its busbar.

A sleeve 26 of polymeric tubing is slid onto the exterior of the guide tube 23 to protect it. The sleeve 26 extends from the insulating layer 24 to surround the terminal end of the brush member 20. Diametrically spaced clefts 27 in the end of the sleeve 26 serve to act as wiping surfaces to wipe off electrolyte from the periphery of the disc 17 as it is presented to the brush member 20 so that contact of the brush member 20 with caustic soda solution is minimised.

Whilst a compression spring or block has been described a leaf spring clad in a polymeric tube may be used to support the brush member 20 by a cantilever action, an advantage being that such a cantilever has no sliding parts to become encrusted or immovably corroded.

I claim:

1. A method of removing a layer of cobalt from a nickel surface of an article, said method comprising the steps of immersing at least part of the article in an aqueous solution of caustic alkali, and applying an electrical potential difference between the article and a counter electrode which acts as a cathode to strip the cobalt from the article and maintain the nickel in the passive state.

2. A method according to claim 1 wherein the pH value of the caustic solution is greater than 12.5.

3. A method according to claim 1 wherein the pH value is about 14.

4. A method according to claim 1 wherein the aqueous solution is 20% Na OH in distilled water.

5. A method according to claim 1, wherein the electrical potential difference is in the range of 10 to 15 volts.

6. A method according to claim 1 wherein the solution is agitated during application of the electrical potential difference.

7. A method according to claim 1 wherein the article is a disc of aluminium coated with nickel and covered with cobalt.

8. A method according to claim 1 wherein the article stripped of cobalt is immersed in a buffer solution of citric acid and sodium citrate and an electrical potential is applied between the article and a counter electrode to cathodically clean the exposed nickel surface.

9. A method according to claim 8 the article is a disc and a current in the range of 50 $m^A$ to 100 $m^A$ per sq.cm. is passed to effect cathodic cleaning.

10. A method according to claim 1 wherein the article is pretreated by immersion in an acid to remove a carbon or chromium layer covering the cobalt layer.

11. An article prepared according to the process of claim 1.

* * * * *